United States Patent [19]

Weber

[11] Patent Number: 4,949,940

[45] Date of Patent: Aug. 21, 1990

[54] CHARGING ARRANGEMENT FOR SHAFT FURNACES, IN PARTICULAR BLAST FURNACES

[75] Inventor: Ralph Weber, Rio de Janeiro, Brazil

[73] Assignee: Kortec AG, Switzerland

[21] Appl. No.: 420,289

[22] Filed: Oct. 12, 1989

[30] Foreign Application Priority Data

Oct. 13, 1988 [DE] Fed. Rep. of Germany ..... 3834969

[51] Int. Cl.[5] ..... C21B 7/18

[52] U.S. Cl. ..... 266/100; 266/184; 266/199; 414/200

[58] Field of Search ..... 266/184, 199, 100; 414/200

[56] References Cited

U.S. PATENT DOCUMENTS 4,497,609 2/1985 Santen ..... 266/184

FOREIGN PATENT DOCUMENTS 850669 7/1981 U.S.S.R. ..... 266/184

*Primary Examiner*—Melvyn J. Andrews

[57] ABSTRACT

A charging arrangement for shaft furnaces, in particular blast furnaces, comprising a container which is arranged above the shaft furnace and which is subdivided by a separating wall into a lower distributor chamber and an upper lock chamber to which the charging material can be fed from above through a filling hopper. Outside its middle and distributed around its periphery the separating wall includes at least two individually closable bottom openings through which the charging material can be passed from the lock chamber into the distributor chamber. The charging material is fed to the shaft furnace through distributor pipes which connect the distributor chamber to the shaft furnace.

8 Claims, 2 Drawing Sheets

CHARGING ARRANGEMENT FOR SHAFT FURNACES, IN PARTICULAR BLAST FURNACES

DESCRIPTION

Figure 1:
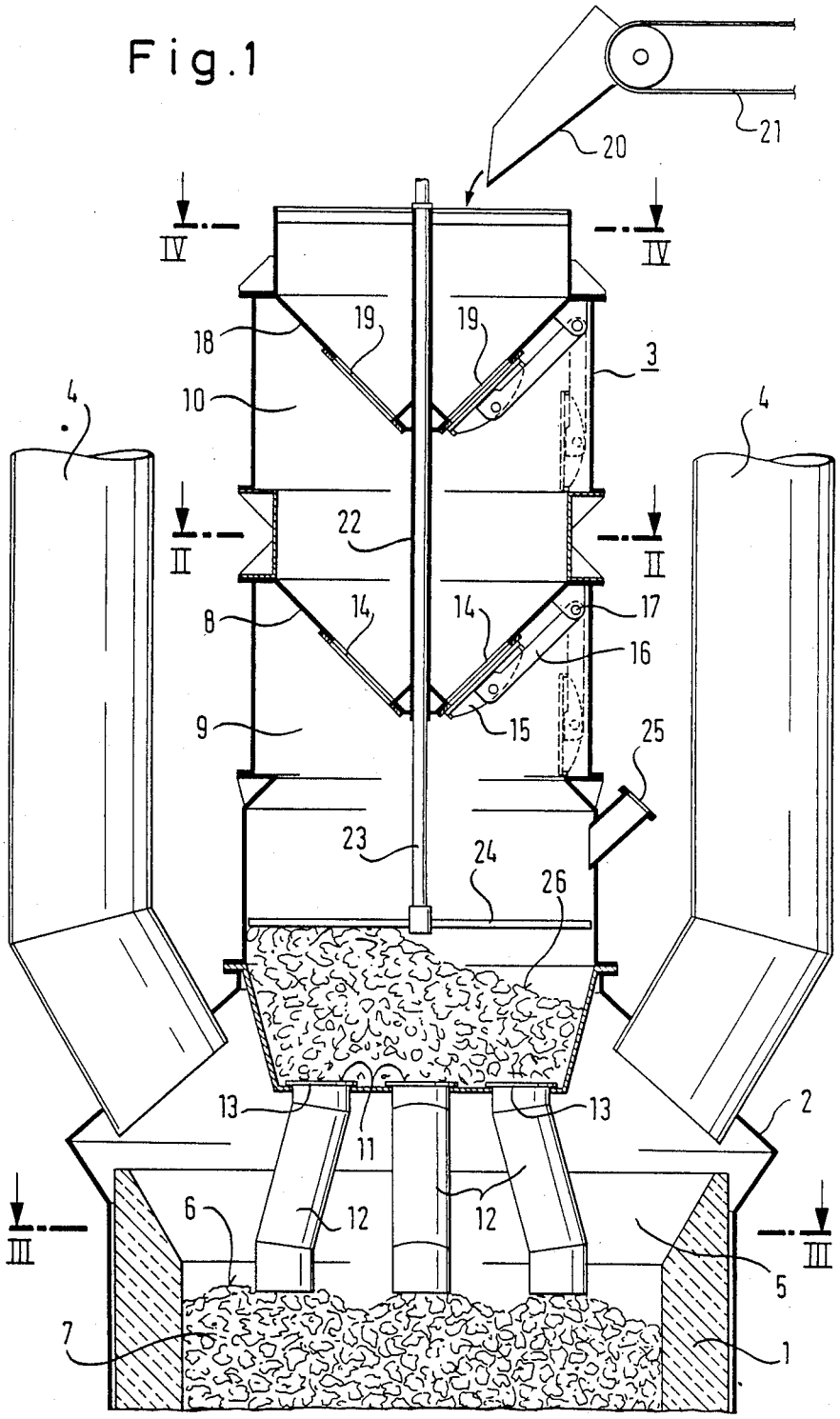

The invention relates to a charging arrangement for shaft furnaces, in particular for blast furnaces.

German utility model No. 75 35 021 discloses a charging arrangement of that kind, comprising two containers which are gas-tightly closed off relative to each other by container valves and which are arranged in superposed relationship. Disposed in the bottom of the lower container are distributor pipes for feeding the charging material into the shaft furnace while disposed in the side wall of the lower container is a bar-like contact which extends into the material forming the furnace burden. The contact serves to monitor the height of the furnace burden in the lower container and to transfer charging material from the upper container into the lower container when the level of the furnace burden in the lower container falls below a minimum level, thereby ensuring that the distributor pipes are always filled with material. That ensures on the one hand that the hot dusty gases from the blast furnace do not pass by way of the distributor pipes into the lower container so that the container valves at the lock closure devices are not exposed to the high temperatures of the shaft furnace waste gases and therefore even heat-sensitive materials such as neoprene which permit a better sealing action can be used for the sealing members; it also means on the other hand however that, in spite of a furnace operating faster at one side, the shaft furnace always has the same level of charging material which is determined by the level of the lower discharge openings of the distributor pipes which are distributed over the cross-section of the shaft furnace. As the sealing members are outside the area of action of the hot shaft furnace waste gases, maintenance thereof is also simplified and it is possible to carry out a maintenance operation without interrupting operation of the furnace. When the furnace is not in a smelting condition, the space above the distributor pipes which are filled with material can be kept gas-free and thus all repair operations at the lock closure devices can be carried out without danger.

DE-B1-1 035 367 discloses a charging arrangement for shaft furnaces, in which the furnace burden is also fed to the shaft furnace from a distributor chamber arranged above the shaft furance, by way of a plurality of distributor pipes which are arranged concentrically to the axis of the furnace. In order to ensure that gas passes uniformly through the entire cross-section of the furnace, a distributor pipe is arranged above each blowing tuyere of the blast furnace. The entire flow of furnace burden is passed successively to the individual distributor pipes, in order to provide a uniform charging action. That can be achieved for example by means of a rotatable feed chute which is disposed in the distributor chamber.

A large number of charging arrangements are known, with which the charging material can be fed to different regions of the cross-section of the shaft furnace specifically in accordance with the nature and the gain size of the material, in order thereby to compensate for the shaft furnace operating faster at one side and to ensure that gases pass uniformly through the furnace. In general such arrangements are movable channel members, rotatable and inclinable distributor chutes and so forth (DE-C-749 557 and DEA-A-30 28 209). Insofar as movable distributor arrangements of that kind are exposed to the hot dusty gases from the shaft furnace, maintenance thereof is made more difficult.

The object of the invention, is to provide a charging arrangement which is able to feed the shaft furnace with the charging material in the desired distribution in respect of nature and grain or piece size of the charging material, in order thereby to compensate for one-sided operation of the furnace and to be able to ensure that gases pass uniformly through the entire cross-section of the furnace. The invention seeks to make it possible to achieve that, without using rotatable distributor chutes.

In the construction according to the invention a container which is disposed above the shaft furnace is subdivided by a separating wall into a lower distributor chamber and an upper lock chamber. The separating wall may extend horizontally but preferably it extends inclinedly downwardly towards the middle. Outside its middle and distributed over its periphery the separating wall includes a plurality of individually closable openings. In that way it is possible for the charging material to be fed from the lock chamber to the distributor chamber at one side thereof in a specifically controlled manner, depending on the respective manner of actuation of the individually closable openings, while in that respect it is also possible to make a choice in regard to the grain size of the material, insofar as the lock chamber is filled with material of the desired grain size or the desired nature, prior to the respective closable openings being opened. In a region which is shielded relative to the hot dusty furnace waste gases by the material in the distributor pipes, that charging arrangement only has closure means for openings, which are preferably in the form of pivotable flap closure means and which do not involve any maintenance problems in comparison with rotary chutes or closure means which are exposed to the hot furnace waste gases.

The invention makes use of the fact that, in a charging arrangement in which the charging material is fed by way of a distributor chamber through pipes which are distributed over the cross-section of the shaft furnace, differences in the downward movement of the charging material in the shaft furnace, which are caused by non-uniform operation of the furnace, is compensated by suitably drawing material from the distributor pipes in the distributor chamber, in other words, one-sided operation of the furnace can be detected by viewing the profile of charging material in the distributor chamber and by feeding material of suitable grain size and nature specifically to that region, that material then passing by way of the respective distributor pipes into the desired cross-sectional region of the shaft furnace, it is possible to compensate for the non-uniformity in operation of the furnace. As the specifically controlled distribution effect can be achieved by individually opening openings, the closure members of which are not exposed to high temperatures, it is thus possible with operationally reliable and simple means to compensate for differences in operation of the furnace and to ensure that gases flow uniformly through the furnace.

In accordance with a further development of the invention, mounted in the centre of the container is a vertical rotary shaft, the lower end of which extends into the distributor chamber. Fixed to the lower end of the rotary shaft is a horizontal levelling bar which can be caused to rotate by rotating the rotary shaft. The rotary shaft, together with the levelling bar, can be raised and lowered within the distributor chamber. That makes it possible to provide for mixing of the charging material in the distributor chamber, and levelling it off. At the same time the levelling bar can be used as an indicator member for the level of the bulk material in the distributor chamber. In order to counteract any behaviour on the part of the material which results in the formation of bridge configurations over the tubes, movable additional devices may be installed for improving the through-flow.

Figure 2:
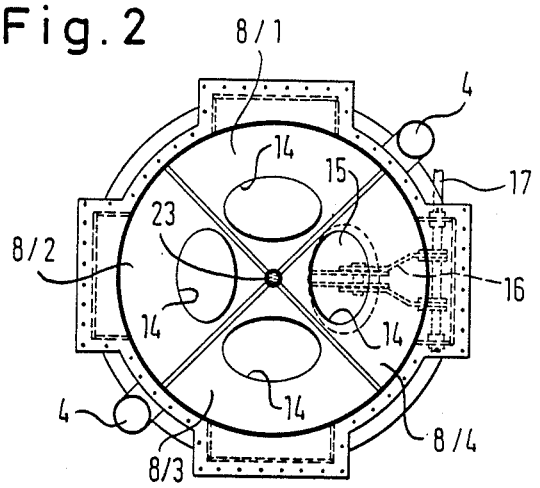
Figure 3:
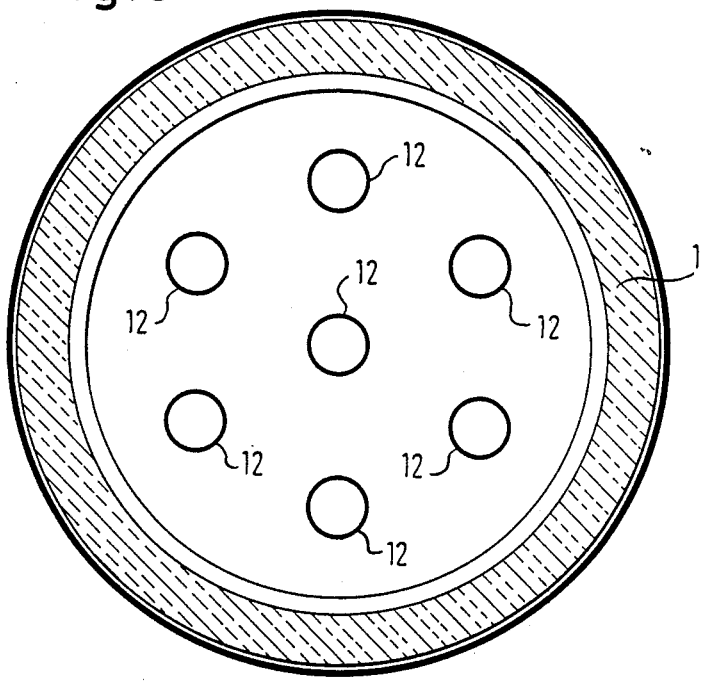

The invention will now be described in greater detail by means of an embodiment with reference to three Figures of drawsing in which:

FIG. 1 is a view in longitudinal section of a charging arrangement according to the invention, FIG. 2 is a view in cross-section taken along line II—II in FIG. 1, and FIG. 3 is a view in cross-section taken along line III—III in FIG. 1.

The charging arrangement shown in FIGS. 1 to 3 for a shaft furnace 1, in a particular a blast furnace, includes a container 3 which is centrally fitted on to the upper end of the shaft furnace by means of a sheet metal closure portion 2 of a conical configuration. Two gas discharge pipes 4 are arranged laterally of the container 3 for discharge of the furnace gases from the shaft furnace 1, the lower ends of the pipes 4 opening into the furnace waste gas space 5 above the surface 6 of the charging material 7 which is introduced into the shaft furnace. The container 3 is subdivided into a lower distributor chamber 9 and an upper lock chamber 10 by a separating wall 8 which extends inclinedly downwardly towards the middle. The bottom of the container 3, which at the same time forms the bottom of the distributor chamber 9, contains a plurality of discharge openings 11 which are distributed over the bottom surface and in which there are disposed distributor pipes 12 which terminate in the upper region of the shaft furnace 1 at a level lower than the upper gas outlet of the shaft furnace, that is to say the intake openings into the gas discharge pipes 4. The arrangement of the distributor pipes 12 which each have at their upper end a respective flange/[13]with which they are supported at the edge of the respective bottom opening 11 can be seen from FIGS. 1 and 3. The cross-sectional view in FIG. 3 shows that in the present embodiment, besides a central distributor pipe, the arrangement also has six distributor pipes 12 which are uniformly arranged around the periphery. The separating wall 8 which at the same time forms the bottom of the lock chamber 10 includes at least two individually closable bottom openings 14, disposed outside the middle of the separating wall 8 and distributed around the periphery thereof. In the illustrated embodiment, as shown by the cross-sectional view in FIG. 2, there are four bottom openings 14. It will moreover be apparent from the cross-sectional views in FIGS. 2 and 3 that both the shaft furnace 1 and the container 3 are of circular cross-section and that the separating wall 8 which extends inclinedly downwardly towards the middle is formed by four circular sectors 8/1 to 8/4. A closable opening 14 is provided in each of those circular sectors.

With a view to simplicity of construction, the circular sectors are of a flat configuration so that the separating wall 8 corresponds to the outside surace of a pyramid which is standing on its tip. Instead of the circular sectors however it is also possible to use sectors of a conical surface. In that case the openings 14 are desirably to be provided with a flange in order to provide flat contact surfaces for the closure members.

In the illustrated embodiment the closure members for the individually closable bottom openings 14 are in the form of flaps 15, one of which is illustrated in each of FIGS. 1 and 2. The respective bottom openings 14 can be closed from below by the respective flaps 15. The flap 15 is shown in solid lines in FIG. 1 in the closure position and in broken lines in the open position. The flaps 15 are mounted in a pivotal arm 16 which is fixed on an actuating shaft 17 which can be individually rotated by drive means (not shown) through a predetermined angle between the closure position and the open position. A neoprene seal is disposed on the side of a flap 15 which bears against the edge of the bottom opening 14, to ensure a gas-tight closure effect in the closed condition of the flap. Instead of a flap. it would also be possible to use other closure members such as slide members or valves.

The lock chamber 10 is closed at the top by a filling hopper 18 which is of the same design configuration as the separating wall 8, in other words, the filling hopper is also formed by four circular segments, each of which has a closable opening 19. In this case also, individually actuable flaps are provided as the closure members. The sectional view indicated at IV—IV in FIG. 1 is therefore represented in the same manner as the sectional view on line II—II, which is shown in FIG. 2.

The space above the filling hopper 18 is intended for receiving the charging material which is to be loaded into the shaft furnace. Diagrammatically illustrated above the space which can be closed by a cover are a chute 20 and a conveyor belt 21. A guide tube 22 which is arranged concentrically with respect to the vertical centre line of the container 3 is fixed in the middle of the separating wall 8 and the hopper 18. A rotary shaft 23 is rotatably and axially displaceably mounted in the guide tube 22. The drives for the rotary and axial movements of the rotary shaft 23 are arranged at the upper end of the rotary shaft but are not shown. Secured to the lower end of the rotary shaft 23 is a levelling bar 24 which is displaced with a circulatory motion when the shaft is rotated and which is raised and lowered within the distributor chamber 9 when the shaft is raised and lowered. Provided in the wall of the container is a window 25 through which the surface of the material in the distributor chamber 9 can be viewed.

The mode of operation of the above-described charging arrangement will now be described.

In operation of the shaft furnace, the charging material 7 moves downwardly within the shaft furnace while to the same extent further charging material is supplied from the distributor chamber 9 by way of the distributor pipes 12 so that the profile of the charging material 6 in the shaft furnace is always kept at approximately the same level. The levelling bar 24 had been raised after the preceding operation of filling the distributor chamber 9 and had been applied to the surface 26 of the material in the distributor chamber 9. As the surface 26 of the material in the distributor chamber moves downwardly, the levelling bar 24 which rests thereon, and the rotary shaft 23, also move downwardly. That downward movement can be used as an indication in regard to the level to which the distributor chamber 9 is filled. It is assumed in the present case that the shaft furnace involves one-sided operation, in other words, in the illustrated case the charging material on the right-hand side of the furnace is consumed more rapidly than that on the left-hand side. Therefore more material is drawn off by way of the distributor pipes 12 which are arranged at the right in FIG. 1 than by way of those which are on the left, so that the one-sided operation of the furnace can be observed by virtue of a corresponding profile 26 of charging material in the distributor chamber 9. By looking through the viewing window 25, it is possible to ascertain that the surface of the charging material falls away towards the right-hand side of the furnace. The greater downward movement in that region of the shaft furnace can be counteracted by for example introducing charging material of smaller grain size on that side, or by introducing charging material of a larger grain size on the opposite side. Suitably selected material is supplied to the filling hopper 18 by way of the conveyor belt 21 and the chute 20. The material is conveyed from the filling hopper 18 into the lock chamber 10 by the openings 19 being opened, and from there the material passes into the distributor chamber by virtue of the right-hand opening 14 of the separating wall 8 being opened. As individual actuation of the closure members of the openings 14 which are arranged in a distributed configuration around the periphery means that the charging material can be introduced at one side and it is also possible to make a suitable choice in respect of the bulk material by way of the feed to the filling hopper 18, it is therefore possible to influence the way in which the furnace operates, in the desired manner.

The levelling bar 24 also makes it possible to mix and level off the charging material which is introduced into the distributor chamber 9 from the lock chamber 10. A levelling effect of that kind is desired so that irregular downward movements of the charging material can be better detected, as the material moves downwardly. When the chamber 9 is refilled with charging material from the lock chamber 10, the levelling bar which previously reached the minimum height in the distributor chamber, is disposed in a plane beneath the freshly introduced material. A rotary movement which can be produced in both directions and a slow lifting movement of the rotary shaft 23 provide for good mixing and levelling of the material which is freshly introduced. After the mixing and levelling operation the rotary shaft 23 is raised, and then lowered on to the surface of the charging material so that the downward movement of the rotary shaft with the material in the distributor chamber 10 can be utilised for monitoring the level to which that chamber is filled with material.

I claim:

1. A charging arrangement for shaft furnaces, in particular for blast furnaces, comprising a distributor chamber which can be arranged above a shaft furnace for which the charging arrangement is to be provided, the distributor chamber including a plurality of discharge openings which are distributed over a bottom surface of the distributor chamber and to which are mounted distributor pipes which terminate in an upper region of the shaft furnace at a level lower than an upper gas outlet of the shaft furnace and which feed charging material to the furnace, distributed over a cross-section thereof, and further comprising a lock chamber which is arranged above the distributor chamber and which includes a closable bottom opening for passing charging material from the lock chamber into the distributor chamber and to which charging material can be fed from above, wherein the improvement comprises that a bottom of the lock chamber is in the form of a separating wall of a container defining the distributor chamber and the lock chamber, the separating wall including at least two individually closable bottom openings outside a center thereof and distributed over a periphery thereof.

2. A charging arrangement according to claim 1, wherein the improvement comprises that the lock chamber is closed at an upper portion thereof by a filling hopper which includes a closable opening for charging material into the lock chamber.

3. A charger arrangement according to claim 2, wherein the improvement comprises that the filling hopper has at least two individually closable openings outside a middle thereof and distributed over a periphery thereof.

4. A charging arrangement according to claim 2 or 3, wherein the improvement comprises that the container is of circular cross-section and the separating wall and/or the filling hopper is formed by circular sectors each having a respective closable opening.

5. A charging arrangement according to claim 4, wherein the improvement comprises that the openings in the separating wall and/or in the filling hopper can be closed from below by flaps.

6. A charging arrangement according to claim 2 or 3, wherein the improvement comprises that secured to a lower end of a rotary shaft which is mounted coaxially in the container is a levelling bar which is arranged transversely with respect to the rotary shaft and which can be set in circulatory motion by the rotary shaft and which can be raised and lowered within the distributor chamber.

7. A charging arrangement according to claim 1 or 2, wherein the improvement comprises that in a wall of the container at the level of the distributor chamber a window is provided for viewing the charging material surface which is formed in the distributor chamber.

8. A charging arrangement according to claim 2 or 3, wherein the improvement comprises that the separating wall extends inclinedly downwardly toward a middle thereof.

* * * * *